US007014812B2

(12) United States Patent
Fukuzumi et al.

(10) Patent No.: US 7,014,812 B2
(45) Date of Patent: Mar. 21, 2006

(54) SULFUR-CONTAINING FREE-CUTTING STEEL FOR MACHINE STRUCTURAL USE

(75) Inventors: Tatsuo Fukuzumi, Tokyo (JP); Motoki Watanabe, Utsunomiya (JP); Tsuneo Yoshimura, Tokyo (JP); Katsuyuki Uchibori, Chiba (JP)

(73) Assignees: Mitsubishi Steel Mfg. Co., Ltd., Tokyo (JP); Yoshimura Technical Office Inc., Tokyo (JP)

( * ) Notice: Subject to any disclaimer, the term of this patent is extended or adjusted under 35 U.S.C. 154(b) by 243 days.

(21) Appl. No.: 10/280,346

(22) Filed: Oct. 25, 2002

(65) Prior Publication Data

US 2004/0003871 A1 Jan. 8, 2004

(30) Foreign Application Priority Data

Jul. 3, 2002 (JP) ..... 2002-194796
Jul. 16, 2002 (JP) ..... 2002-206479

(51) Int. Cl.
*C22C 38/60* (2006.01)

(52) U.S. Cl. ..... 420/84; 420/87; 420/127; 148/327

(58) Field of Classification Search ..... 420/84, 420/87, 127; 148/327
See application file for complete search history.

(56) References Cited

U.S. PATENT DOCUMENTS 4,042,380 A * 8/1977 Yamaguchi et al. ..... 420/87
6,737,019 B1 * 5/2004 Fukuzumi et al. ..... 420/87
6,764,645 B1 * 7/2004 Hayaishi et al. ..... 420/125

FOREIGN PATENT DOCUMENTS

| | | |
|---|---|---|
| JP | 62-278252 | 12/1987 |
| JP | 7-34190 | 2/1995 |
| JP | 2000-160286 | 6/2000 |
| JP | 2000-282169 | 10/2000 |
| JP | 2001-181782 | 7/2001 |

* cited by examiner

*Primary Examiner*—Deborah Yee
(74) *Attorney, Agent, or Firm*—Flynn, Thiel, Boutell & Tanis, P.C.

(57) ABSTRACT

A sulfur-containing free-cutting steel for machine structural use, containing, in weight percent, 0.10 to 0.55% of C, 0.05 to 1.00% of Si, 0.30 to 2.50% of Mn, not more than 0.15% of P, 0.050 to 0.350% of S, more than 0.010% but not more than 0.020% of Al, 0.015 to 0.200% of Nb, 0.0015 to 0.0150% of O, and not more than 0.02% of N, and further containing, in weight percent, at least one selected from the group consisting of 0.03 to 0.50% of V, 0.02 to 0.20% of Ti and 0.01 to 0.20% of Zr, wherein the ratio S/O of the S content to the O content is 15 to 120, and at least one selected from the group consisting of an oxide, a carbide, a nitride and a carbonitride of Nb(see FIG. 1) acts as nuclei for precipitation of MnS type inclusions. A sulfur-containing free-cutting steel for machine structural use is obtained by adjusting the chemical composition of steel and provides a sulfur free-cutting steel that does not contain lead but has a machinability and mechanical properties on a par with conventional lead-containing free-cutting steel.

8 Claims, 2 Drawing Sheets

SULFUR-CONTAINING FREE-CUTTING STEEL FOR MACHINE STRUCTURAL USE

BACKGROUND OF THE INVENTION

1. Field of the Invention

The present invention relates to a steel for machine structural use that has excellent machinability and is used as a raw material for industrial equipment, automobile components and the like.

2. Description of the Prior Art

Steel products that are machined for use in industrial machinery, automobile components and the like need to have excellent machinability. As steels for machine structural use that have excellent machinability, sulfur free-cutting steel containing at least a certain level of sulfur and lead free-cutting steel containing a small amount of lead are specified in the Japanese Industrial Standards (JIS). In addition, free-cutting steels containing elements having properties similar to those of lead such as Bi, Te or Se have been developed, but have not become widespread in industry for reasons such as high price.

The steel for which results in terms of machinability can be expected with most certainty is lead free-cutting steel, and a most significant characteristic feature of this steel has been that the mechanical properties of the steel are not degraded even though lead is contained therein. However, during the process of manufacturing lead free-cutting steel and the process of cutting or turning the steel material, lead is scattered into the air as fumes, thus degrading the working environment and, moreover, when disposing of industrial waste generated through these processes such as slag and chips, problems arise in terms of environmental protection due to the steel containing lead.

On the other hand, regarding sulfur free-cutting steel, which has the longest history as free-cutting steel, there are great variations in terms of the form and distribution of sulfides in industrially manufactured steel and hence the reliability with regard to the machinability has been poor. There has also been the problem that if one attempts to improve the machinability by making the sulfur content high, then hot brittleness may occur during the process of manufacturing the steel material, resulting in many defective articles.

Nevertheless, unlike lead, sulfur has few problems in terms of health and safety, environmental issues and so on, and hence people have been awaiting the development of a sulfur free-cutting steel that does not contain lead but has a machinability on a par with conventional lead-containing free-cutting steel. It is thus an object of the present invention to provide a sulfur-containing free-cutting steel for machine structural use that has excellent machinability.

SUMMARY OF THE INVENTION

The present inventors carried out various studies into the chemical components of steel with an aim of developing a free-cutting steel that has a machinability on a par with conventional lead-containing free-cutting steel but without adding lead. As a result, it was discovered that in the case that 0.0015 to 0.0150 wt %, preferably 0.0020 to 0.0100 wt %, of oxygen is contained in a sulfur free-cutting steel that contains 0.050 to 0.350 wt % of S, if the ratio S/O of the S content to the O content is in a range of 15 to 120, then the machinability of the steel is assuredly improved.

That is, the free-cutting steel according to the present invention is the sulfur-containing free-cutting steel for machine structural use indicated below.

(1) A sulfur-containing free-cutting steel for machine structural use, comprising, in weight percent, 0.10 to 0.55% of C, 0.05 to 1.00% of Si, 0.30 to 2.50% of Mn, not more than 0.15% of P, 0.050 to 0.350% of S, more than 0.010% but not more than 0.020% of Al, 0.015 to 0.200% of Nb, 0.0015 to 0.0150% of O, and not more than 0.02% of N, and further containing, in weight percent, at least one selected from the group consisting of 0.03 to 0.50% of V, 0.02 to 0.20% of Ti and 0.01 to 0.20% of Zr, wherein the ratio S/O of the S content to the O content is 15 to 120, and at least one selected from the group consisting of an oxide, a carbide, a nitride and a carbonitride of Nb acts as nuclei for precipitation of MnS type inclusions.

(2) The sulfur-containing free-cutting steel for machine structural use described in (1) above, wherein the free-cutting steel contains, in weight percent, at least one selected from the group consisting of 0.020 to 0.100% of Sn and 0.015 to 0.100% of Sb.

(3) The sulfur-containing free-cutting steel for machine structural use described in (1) or (2) above, wherein the free-cutting steel contains, in weight percent, at least one selected from the group consisting of 0.10 to 2.0% of Cr, 0.10 to 2.0% of Ni and 0.05 to 1.0% of Mo.

(4) The sulfur-containing free-cutting steel for machine structural use according to any of (1) to (3) above, wherein said free-cutting steel contains, in weight percent, at least one selected from the group consisting of 0.0002 to 0.020% of Ca and 0.0002 to 0.020% of Mg.

DESCRIPTION OF THE PREFERRED EMBODIMENTS

Figure 1:
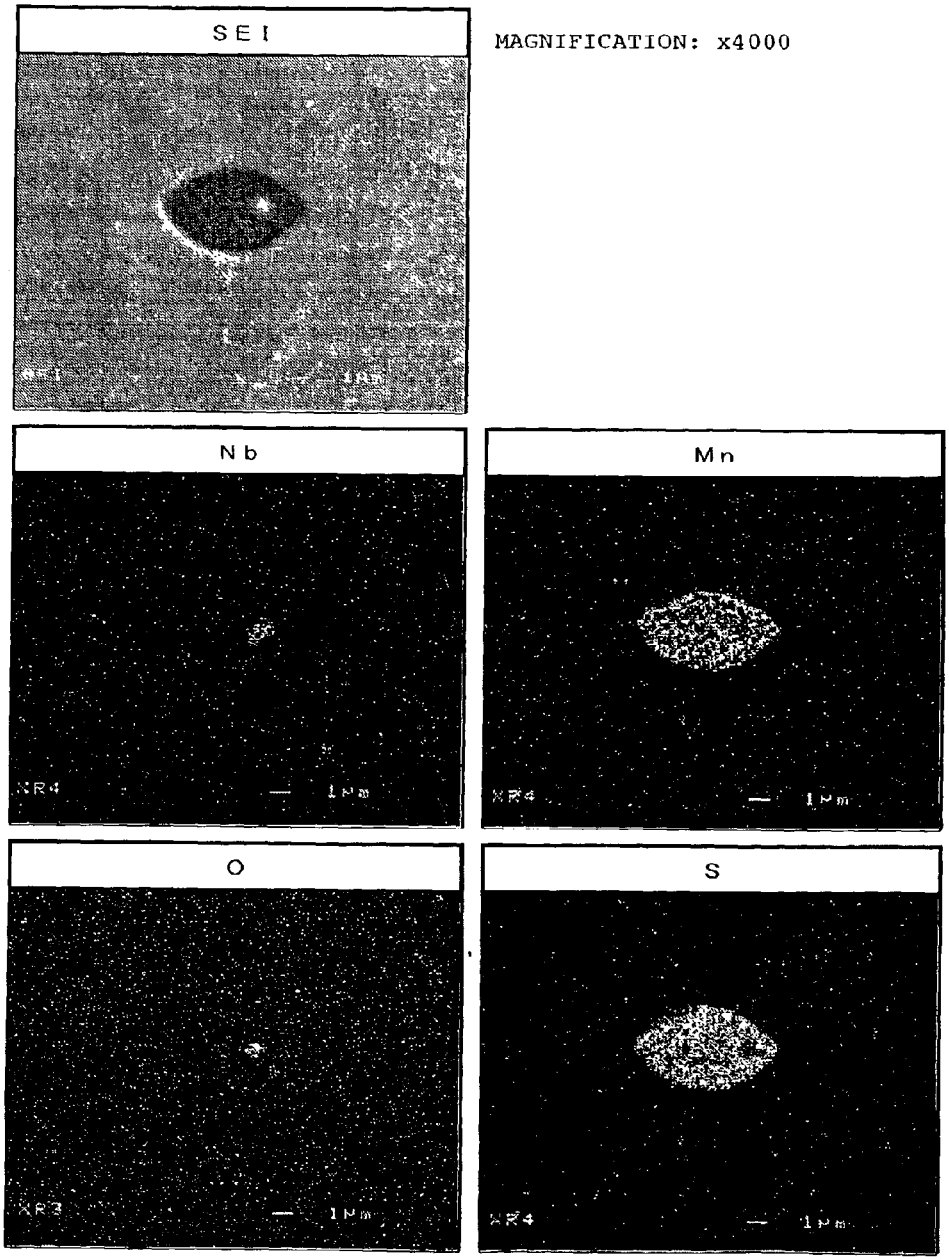
FIG. 1 is EPMA analysis images showing that an MnS type inclusion with an oxide of Nb as a nucleus has been produced in a sulfur-containing free-cutting steel for machine structural use according to the present invention.

Following is a description of reasons for the limits on the contents of the constituent elements in the sulfur-containing free-cutting steel for machine structural use of the present invention. The contents are expressed by weight percent.

C: 0.10 to 0.55%

C is added to secure the strength of the steel; a strength of the order of that of medium/high carbon steel is targeted, and hence at less than 0.10% the required strength will not be obtained, whereas if the carbon content exceeds 0.55% then the toughness will drop. The lower limit was thus made to be 0.10%, and the upper limit 0.55%.

Si: 0.05 to 1.00%

Si is added as a deoxidizer, thus causing cooperative deoxidation with Mn to be carried out. The deoxidation effect appears with addition of about 0.05%, but if the amount added exceeds 1.00% then the machinability of the steel will drop. The lower limit was thus made to be 0.05%, and the upper limit 1.00%.

Mn: 0.30 to 2.50%

Mn is added as a deoxidizer, and moreover to form MnS and thus improve the machinability of the steel. To form the sulfide, it is necessary for at least 0.30% of Mn to be contained, but if the Mn content exceeds 2.50% then the hardness of the steel will rise and hence the machinability will drop. The lower limit was thus made to be 0.30%, and the upper limit 2.50%.

Al: More Than 0.010% But Not More Than 0.020%

Al is an element that bonds to N in the steel to form AlN and has an effect of making the austenite grains fine; it contributes to improving the toughness through this refining effect. To produce this effect, it is necessary to add more than 0.010%. However, adding too much results in the machinability deteriorating. To avoid this, it is necessary to make the upper limit 0.020%. The amount of Al added was thus made to be more than 0.010% but not more than 0.020%.

P: Not More Than 0.15%

P is added to improve the machinability of the steel, in particular the characteristics of the finished surface. If the amount of P added exceeds 0.15% then the toughness drops. The upper limit was thus made to be 0.15%.

S: 0.050 to 0.350%

S is well known as an element that improves the machinability of steel, and the higher the S content the better the machinability. At less than 0.050%, good machinability is not obtained. However, even in the case of adding S together with Mn, if the S content is too high then the hot workability of the steel will drop. The upper limit was thus made to be 0.350%.

O: 0.0015 to 0.0150%

If the oxygen content is less than 0.0015% then there will be insufficient formation of the MnS inclusion to give good machinability, but if the oxygen content exceeds 0.0150% then the amount of secondary deoxidation products generated through deoxidation during cooling will be too high, resulting in the machinability deteriorating. Keeping the oxygen content in a range of 0.0015 to 0.0150%, and keeping the ratio S/O of the S content to the O content in a range of 15 to 120 are important for improving the machinability of the steel. The oxygen content was thus made to be in a range of 0.0015 to 0.0150%.

N: Not More Than 0.02%

If the N content exceeds 0.02%, then the ductility of the steel will drop. The upper limit was thus made to be 0.02%.

Cr: 0.10 to 2.00%

Ni: 0.10 to 2.00%

Mo: 0.05 to 1.00%

One or a plurality selected from Cr, Ni and Mo is/are added.

If the content of one of Cr, Ni and Mo is less than the above-mentioned lower limit, then it will not be possible to secure the hardenability and the toughness of the steel. If the contents of Cr, Ni and Mo exceed the above-mentioned respective upper limits, then the hardness of the steel will rise and hence the machinability will become poor. The ranges of the amounts of Cr, Ni and Mo added were thus made to be as above.

Nb: 0.015 to 0.200%

If the Nb content is in the above-mentioned range, then a suitable amount of at least one of an oxide, a carbide, a nitride and a carbonitride of Nb will precipitate in the steel, becoming nuclei for precipitation of the MnS type inclusions, and thus aiding the precipitation and uniform distribution of the inclusions through the steel. Specifically, if the Nb content is less than 0.015% then there will be little such effect, whereas if the Nb content exceeds 0.20% then the machinability of the steel will become poor. Moreover, a suitable amount of Nb will make the austenite grain size of the steel smaller and hence will not impair the toughness of the steel.

V: 0.03 to 0.50%

If the V content is within the above range, then a carbonitride of V will precipitate to a suitable degree in the gamma iron, acting to improve the mechanical properties of the steel. Moreover, a suitable amount of V will make the austenite grain size of the steel smaller and hence will not impair the toughness of the steel. The amount of V added was thus made to be in a range of 0.03 to 0.50%.

Ti: 0.02 to 0.20%

Zr: 0.01 to 0.20%

These elements have a strong affinity to oxygen, readily producing an oxide, and hence it is preferable to add them to the molten steel after the deoxidation operation has been completed.

At a Ti content of less than 0.02% or a Zr content of less than 0.01% there will be little deoxidation effect, whereas if the Ti content exceeds 0.20% or the Zr content exceeds 0.20% then a large amount of carbonitrides that cause a worsening in the machinability will be produced. Moreover, a suitable amount of Ti will make the austenite grain size of the steel finer and hence will not impair the toughness of the steel. The amounts of Ti and Zr added were thus made to be within the above ranges.

Sn: 0.020 to 0.100%

Sn exists in the state of a solid solution in the matrix and hence embrittles the steel, thus improving the machinability. To produce this effect, it is necessary to add at least 0.020%. However, if too much is added then the toughness will be degraded. To avoid this, it is necessary to make the upper limit 0.100%. The amount of Sn added was thus made to be within a range of 0.020 to 0.100%.

Sb: 0.015 to 0.100%

Sb exists in the state of a solid solution in the matrix and hence embrittles the steel, thus improving the machinability. To produce this effect, it is necessary to add at least 0.015%. However, if too much is added then the toughness will be degraded. To avoid this, it is necessary to make the upper limit 0.100%. The amount of Sb added was thus made to be within a range of 0.015 to 0.100%.

Ca: 0.0002 to 0.020%

Ca acts as a deoxidizing element in the steel and forms an oxide which is effective in improving the machinability of the steel. This effect cannot be observed when the Ca content is less than 0.0002%. However, even if Ca is added in an amount of more than 0.020%, any further effect will not be obtained in machinability. Therefore, the addition of Ca was made to be within the range of 0.0002 to 0.020%.

Mg: 0.0002 to 0.020%

Mg acts as a deoxidizing element in the steel and forms an oxide which is effective in improving the machinability of the steel. This effect cannot be observed when the Mg content is less than 0.0002%. However, even if Mg is added in an amount of more than 0.020%, any further effect will not be obtained in machinability. Therefore, the addition of Mg was made to be within the range of 0.0002 to 0.020%.

Following is a detailed description of the present invention through examples.

EXAMPLE 1

Manufacture of Sulfur-Containing Free-Cutting Steel for Machine Structural Use Sulfur-containing free-cutting steels for machine structural use were manufactured through the following process.

A steel having a composition corresponding to each steel for machine structural use, shown in Table 1 (test piece Nos. 1–22) was melted using a 15-ton electric furnace. 0.3% of decarbonization was carried out during the oxidation stage, and the amount of oxygen in the molten steel at the end of the oxidation stage was in a range of 0.028 to 0.042%. Slag at the oxidation stage was removed, and another slag was created anew at the reduction stage. The deoxidizers used in the initial deoxidation were 60 kg of Fe—Si and 100 kg of Si—Mn. After that, 5 kg (10 kg for the comparative materials) of Al was used. After confirming that the FeO content in the slag had become 2% or less, the molten steel was tapped into a ladle.

The amount of oxygen in the molten steel at this time was in a range of 0.0050 to 0.0130%. Next, after placing the ladle in the position of a ladle refining furnace (LF furnace), the temperature of the molten steel was raised using the arc and fine adjustment was carried out on each composition. After the temperature of the molten steel had become 1650° C., resulfurization and mild oxygen enriching were carried out, argon gas was blown in at a flow rate of 30 l/min from a porous plug installed in the bottom of the ladle, and agitation was carried out for 15 minutes. After that, the temperature was raised using the arc of the LF furnace, and then Nb, Ti and Zr were added, and a 4.7-ton steel ingot was cast. The steel ingot was rolled into rods of diameter 100 mm, and test pieces to be submitted to cutting tests were produced from the rods. The chemical compositions obtained are shown in Table 1 below. The contents are expressed by weight percent, except that N and O are expressed by ppm.

TABLE 1

| Test piece | C | Si | Mn | P | S | Ni | Cr | Mo | Al | Nb | V | Ti | Zr | Sn |
|---|---|---|---|---|---|---|---|---|---|---|---|---|---|---|
| 1 | 0.45 | 0.25 | 0.73 | 0.009 | 0.093 | 0.01 | 0.14 | 0.01 | 0.019 | — | — | — | — | — |
| 2 | 0.45 | 0.26 | 0.71 | 0.010 | 0.068 | 0.01 | 0.14 | 0.02 | 0.015 | — | — | — | — | — |
| 3 | 0.49 | 0.26 | 0.99 | 0.007 | 0.019 | 0.01 | 0.19 | 0.01 | 0.031 | — | 0.10 | — | — | — |
| 4 | 0.48 | 0.24 | 0.97 | 0.010 | 0.054 | 0.01 | 0.16 | 0.02 | 0.025 | — | 0.10 | — | — | — |
| 5 | 0.21 | 0.32 | 0.65 | 0.012 | 0.008 | 1.82 | 0.55 | 0.16 | 0.033 | — | — | — | — | — |
| 6 | 0.22 | 0.28 | 0.65 | 0.015 | 0.012 | 1.63 | 0.60 | 0.16 | 0.035 | — | — | — | — | — |
| 7 | 0.21 | 0.33 | 0.63 | 0.015 | 0.010 | 1.65 | 0.63 | 0.17 | 0.035 | — | — | — | — | — |
| 8 | 0.43 | 0.24 | 0.66 | 0.011 | 0.073 | 0.00 | 0.05 | 0.01 | 0.014 | 0.047 | 0.10 | — | — | — |
| 9 | 0.42 | 0.97 | 0.66 | 0.009 | 0.193 | 0.00 | 0.03 | 0.01 | 0.017 | 0.015 | 0.09 | 0.05 | 0.08 | — |
| 10 | 0.53 | 0.18 | 0.67 | 0.010 | 0.199 | 0.00 | 0.05 | 0.01 | 0.015 | 0.039 | 0.08 | — | 0.07 | — |
| 11 | 0.43 | 0.17 | 0.65 | 0.008 | 0.187 | 0.01 | 0.05 | 0.01 | 0.018 | 0.185 | 0.13 | — | — | 0.030 |
| 12 | 0.45 | 0.23 | 0.63 | 0.013 | 0.120 | 0.02 | 0.03 | 0.01 | 0.020 | 0.029 | — | — | — | — |
| 13 | 0.42 | 0.15 | 0.71 | 0.011 | 0.231 | 0.00 | 0.03 | 0.01 | 0.013 | 0.023 | — | 0.06 | 0.08 | 0.086 |
| 14 | 0.25 | 0.17 | 2.28 | 0.020 | 0.220 | 1.56 | 0.75 | 0.17 | 0.018 | 0.030 | 0.07 | — | — | — |
| 15 | 0.24 | 0.23 | 0.73 | 0.018 | 0.195 | 1.53 | 0.83 | 0.97 | 0.017 | 0.025 | — | — | 0.08 | — |
| 16 | 0.20 | 0.18 | 0.65 | 0.015 | 0.210 | 1.60 | 1.98 | 0.16 | 0.015 | 0.027 | — | 0.16 | — | — |
| 17 | 0.30 | 0.15 | 0.68 | 0.145 | 0.200 | 1.66 | 0.93 | 0.16 | 0.016 | 0.028 | 0.18 | 0.08 | — | 0.033 |
| 18 | 0.13 | 0.10 | 1.30 | 0.023 | 0.230 | 1.95 | 0.61 | 0.15 | 0.015 | 0.030 | — | 0.05 | 0.07 | — |
| 19 | 0.21 | 0.73 | 0.69 | 0.024 | 0.325 | 1.73 | 0.58 | 0.18 | 0.019 | 0.020 | 0.45 | — | 0.09 | 0.027 |
| 20 | 0.44 | 0.22 | 0.40 | 0.013 | 0.185 | 0.01 | 0.04 | 0.01 | 0.013 | 0.023 | 0.10 | — | 0.10 | — |
| 21 | 0.45 | 0.20 | 0.70 | 0.005 | 0.130 | 0.02 | 0.05 | 0.01 | 0.014 | 0.027 | — | 0.07 | 0.07 | — |
| 22 | 0.46 | 0.45 | 0.53 | 0.016 | 0.225 | 1.12 | 0.59 | 0.14 | 0.016 | 0.028 | 0.15 | — | — | 0.030 |

| Test piece | Sb | Pb | Ca | Mg | N | O | S/O |
|---|---|---|---|---|---|---|---|
| 1 | — | 0.29 | — | — | 117 | 17 | 54.7 |
| 2 | — | 0.21 | — | — | 101 | 12 | 56.7 |
| 3 | — | 0.06 | — | — | 104 | 13 | 14.6 |
| 4 | — | 0.29 | — | — | 91 | 8 | 67.5 |
| 5 | — | — | — | — | 120 | 28 | 2.9 |
| 6 | — | — | — | — | 128 | 22 | 5.5 |
| 7 | — | 0.07 | — | — | 116 | 16 | 6.3 |
| 8 | — | — | — | — | 55 | 18 | 40.6 |
| 9 | — | — | — | — | 42 | 66 | 29.2 |
| 10 | — | — | — | — | 43 | 80 | 24.9 |
| 11 | — | — | — | — | 53 | 70 | 26.7 |
| 12 | 0.083 | — | — | — | 48 | 40 | 30.0 |
| 13 | 0.025 | — | — | — | 45 | 53 | 43.6 |
| 14 | — | — | — | — | 140 | 50 | 44.0 |
| 15 | — | — | — | — | 120 | 36 | 54.2 |
| 16 | — | — | — | — | 125 | 42 | 50.0 |
| 17 | — | — | — | — | 145 | 33 | 60.6 |
| 18 | 0.061 | — | — | — | 133 | 48 | 47.9 |
| 19 | 0.030 | — | — | — | 162 | 34 | 95.6 |
| 20 | 0.042 | — | 0.0120 | — | 50 | 62 | 29.8 |
| 21 | — | — | — | 0.0060 | 30 | 50 | 26.0 |
| 22 | — | — | 0.01 | 0.0043 | 51 | 48 | 46.9 |

by weight percent; ppm for N and O
Test piece No. 1–7: Comparative materials
Test piece No. 8–22: Materials of invention

EXAMPLE 2

EPMA Analysis of Precipitation Nuclei in MnS Type Inclusions

Figure 2:
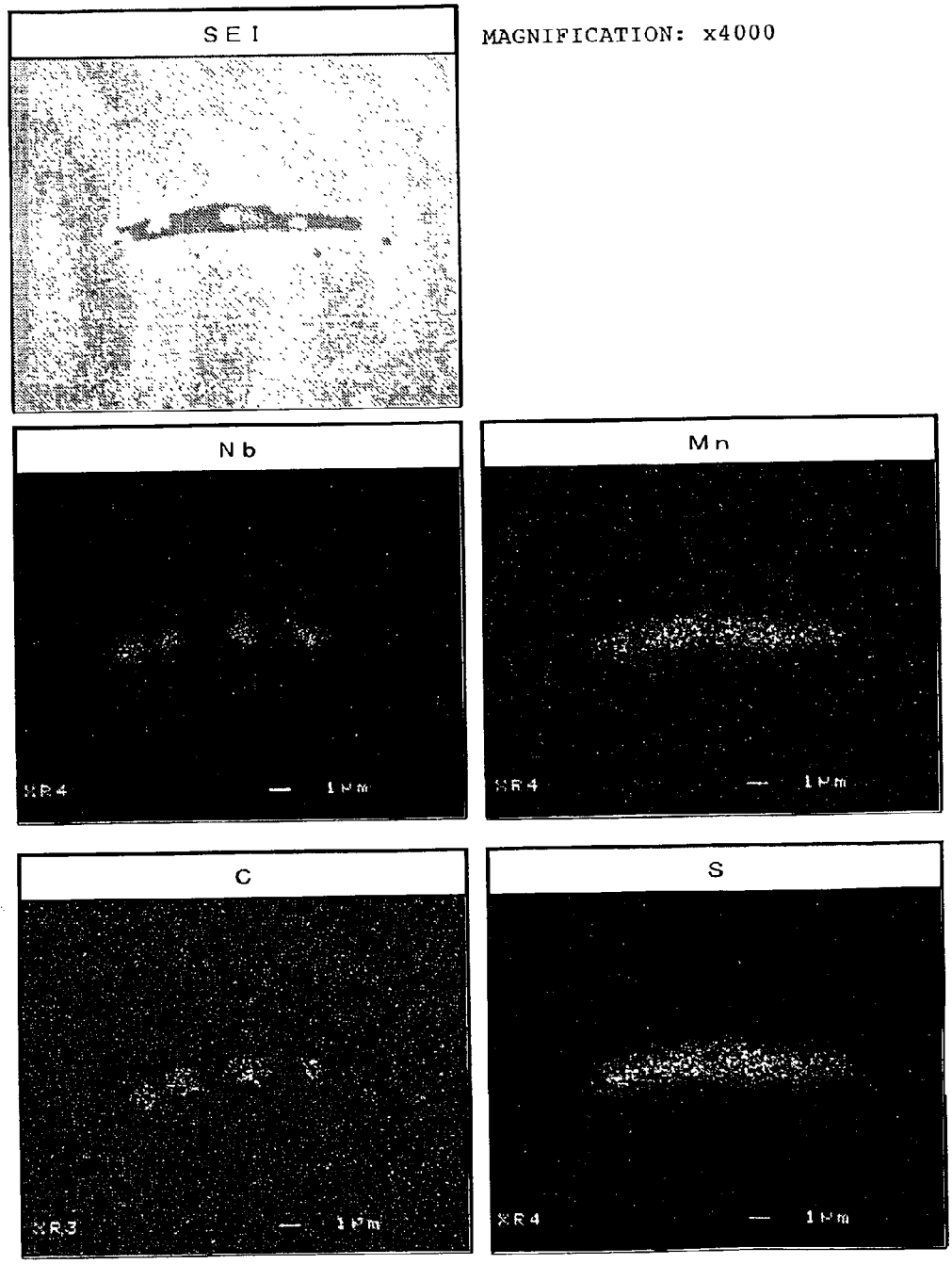
FIG. 2 is EPMA analysis images showing that an MnS type inclusion with a carbide of Nb as a nucleus has been produced in the above-mentioned steel.

To verify the role of Nb, which acts as precipitation nuclei for MnS type inclusions, in the sulfur-containing free-cutting steel for machine structural use of the present invention, the steel of test piece 8 (material of the invention) was analyzed with an electron probe microanalyzer (EPMA) The results are shown in FIGS. 1 and 2.

FIG. 1 consists of EPMA images showing that an MnS type inclusion with an oxide of Nb as a nucleus has been produced, and FIG. 2 consists of EPMA images showing that an MnS type inclusion with a carbide of Nb as a nucleus has been produced.

The photographs labeled 'SEI' are secondary electron images of the MnS type inclusion precipitated in the matrix. In both FIG. 1 and FIG. 2, a relatively small island-shaped body is shown enclosed in a large island-shaped phase. The four EPMA analysis images at the lower part of each figure show that the small island-shaped phase is an Nb oxide in the case of FIG. 1 and an Nb carbide in the case of FIG. 2. The photographs are analysis images of the elements Nb, O, C, Mn and S, with white parts showing places where the respective element exists. It is clear from these photographs that the small island-shaped phase is an Nb oxide or an Nb carbide, and it can be seen that the Nb oxide or Nb carbide has acted as a nucleus for the MnS type inclusion (the large island-shaped phase).

EXAMPLE 3

Cutting Test by Turning 100 mm-diameter rods obtained from the same heats as the steels of pieces 1 to 22 were annealed, each test piece was subjected to cutting by turning for 32 minutes using a tungsten carbide tipped tool, and crater wear of the cutting face of the tool was measured. The turning rate was 160 m/min. The results are shown in Table 2.

TABLE 2

| Test piece | | With no cutting fluid Units: mm | Using cutting fluid Units: mm |
|---|---|---|---|
| Comparative materials | Average for test pieces 5 and 6 (lead-free steel) | 0.4 | 0.15 |
| | Average for test pieces 1~4 and 7 (lead-containing steel) | 0.1 | 0.05 |
| Materials of invention | Average for test pieces 8~22 | 0.1 | 0.05 |

The tool wear for the materials of the present invention when cutting fluid was not used was about ¼ that for the comparative materials of test pieces 5 and 6.

Moreover, both in the case of not using the cutting fluid and in the case of using the cutting fluid, the values for the materials of the present invention were comparable to those for the lead free-cutting steels of test pieces 1~4 and 7.

Next, a comparison was carried out for the productivity of the turning work using commercially sold cutting oil.

For this comparison, pinions were produced from each of the above test pieces by a cutting process by turning, using a high-speed tool. The productivity was measured through the number of pinions produced per hour. The results are shown in Table 3.

TABLE 3

| Test piece | | Using commercially solid cutting fluid Number of pieces/hour |
|---|---|---|
| Comparative materials | 1 | 130 |
| | 2 | 138 |
| | 3 | 105 |
| | 4 | 140 |
| | 5 | 72 |
| | 6 | 85 |
| | 7 | 135 |
| Materials of invention | 8 | 125 |
| | 9 | 130 |
| | 10 | 128 |
| | 11 | 125 |
| | 12 | 138 |
| | 13 | 142 |
| | 14 | 123 |
| | 15 | 134 |
| | 16 | 110 |
| | 17 | 120 |
| | 18 | 131 |
| | 19 | 125 |
| | 20 | 133 |
| | 21 | 124 |
| | 22 | 118 |

The productivity for the materials of the present invention when using the commercially sold cutting fluid was improved by 60% compared with the lead-free comparative materials 5 and 6. Moreover, the materials of the present invention gave good results that hardly differed from those of the lead free-cutting steels of comparative materials 1~4 and 7.

EXAMPLE 4

Measurement of Mechanical Properties

The mechanical properties as steel for machine structural use were measured for the test pieces 1 to 22. Parameters related to the strength, ductility, toughness and hardness were measured for each of the test pieces after carrying out oil quenching at 850° C. and tempering at 650° C.; the results are shown in Table 4.

For all of the properties, the materials of the present invention showed values approximately the same as or better than those of the comparative materials.

TABLE 4

| Test piece | 0.2% proof stress $N/mm^2$ | Tensile strength $N/mm^2$ | Percentage elongation % | Percentage area reduction % | Charpy impact value $J/cm^2$ | Hardness HB |
|---|---|---|---|---|---|---|
| 1 | 635 | 705 | 25.8 | 61.4 | 130 | 211 |
| 2 | 657 | 730 | 25.5 | 62.1 | 133 | 220 |
| 3 | 707 | 786 | 24.9 | 60.3 | 128 | 239 |
| 4 | 691 | 768 | 25.2 | 61.8 | 130 | 235 |
| 5 | 732 | 854 | 22.7 | 58.1 | 125 | 270 |
| 6 | 743 | 865 | 22.2 | 57.6 | 120 | 272 |
| 7 | 754 | 870 | 21.3 | 56.2 | 117 | 273 |
| 8 | 635 | 705 | 26.0 | 63.0 | 153 | 211 |
| 9 | 558 | 620 | 27.7 | 65.4 | 161 | 190 |
| 10 | 597 | 663 | 26.3 | 62.5 | 142 | 200 |
| 11 | 715 | 830 | 22.2 | 59.3 | 142 | 269 |
| 12 | 648 | 713 | 27.3 | 64.2 | 167 | 223 |
| 13 | 652 | 724 | 26.4 | 63.2 | 158 | 227 |
| 14 | 730 | 840 | 23.0 | 58.3 | 129 | 267 |
| 15 | 760 | 873 | 21.0 | 56.1 | 115 | 274 |
| 16 | 732 | 860 | 22.5 | 57.1 | 125 | 270 |
| 17 | 750 | 865 | 22.9 | 56.9 | 118 | 276 |
| 18 | 730 | 850 | 23.2 | 58.7 | 130 | 273 |
| 19 | 740 | 858 | 22.5 | 57.3 | 123 | 277 |

TABLE 4-continued

| Test piece | 0.2% proof stress N/mm$^2$ | Tensile strength N/mm$^2$ | Percentage elongation % | Percentage area reduction % | Charpy impact value J/cm$^2$ | Hardness HB |
|---|---|---|---|---|---|---|
| 20 | 668 | 733 | 23.3 | 59.8 | 140 | 230 |
| 21 | 637 | 710 | 27.2 | 63.2 | 165 | 210 |
| 22 | 685 | 758 | 24.1 | 57.7 | 151 | 233 |

Test piece Nos. 1–7: Comparative materials
Test piece Nos. 8–22: Materials of invention

EXAMPLE 5

Measurement of Austenite Grain Size

The austenite grain size was measured for test pieces 1 to 22 in accordance with JISG0551. The results are shown in FIG. 5.

The austenite grain size numbers were No. 8 or above, with the materials of the present invention and the comparative materials showing approximately the same values.

TABLE 5

| Test piece | | Austenite grain size number |
|---|---|---|
| Comparative materials | 1 | 9.0 |
| | 2 | 8.7 |
| | 3 | 8.8 |
| | 4 | 8.9 |
| | 5 | 9.0 |
| | 6 | 9.0 |
| | 7 | 8.9 |
| Materials of invention | 8 | 8.9 |
| | 9 | 8.8 |
| | 10 | 8.8 |
| | 11 | 8.7 |
| | 12 | 8.7 |
| | 13 | 8.8 |
| | 14 | 9.0 |
| | 15 | 9.1 |
| | 16 | 9.0 |
| | 17 | 9.0 |
| | 18 | 8.9 |
| | 19 | 9.1 |
| | 20 | 8.9 |
| | 21 | 9.1 |
| | 22 | 8.7 |

As described above, according to the present invention, a sulfur-containing steel for machine structural use that has few problems in terms of health and safety, environmental issues and so on, but has machinability and mechanical properties on a par with conventional lead-containing free-cutting steel can be provided.

What is claimed is:

1. A sulfur-containing free-cutting steel for machine structural use, consisting of, in weight percent, 0.10 to 0.55% of C, 0.05 to 1.00% of Si, 0.30 to 2.50% of Mn, not more than 0.15% of P, 0.050 to 0.350% of S, more than 0.010% but not more than 0.020% of Al, 0.015 to 0.200% of Nb, 0.0033 to 0.0150% of O, and not more than 0.02% of N, and further containing, in weight percent, at least one selected from the group consisting of 0.03 to 0.50% of V, 0.02 to 0.20% of Ti and 0.01 to 0.20% of Zr, and, optionally, at least one selected from the group consisting of 0.020 to 0.100% of Sn and 0.050 to 0.100% of Sb, at least one selected from the group consisting of 0.10 to 2.00% of Cr, 0.10 to 2.00% of Ni and 0.05 to 1.00% of Mo and 0.0002 to 0.020% of Mg, wherein the ratio S/O of the S content to the O content is 15 to 120, and at least one selected from the group consisting of an oxide and a carbide of Nb acts as nuclei for precipitation of MnS inclusions.

2. The sulfur-containing free-cutting steel for machine structural use according to claim 1, wherein said free-cutting steel contains, in weight percent, at least one selected from the group consisting of 0.020 to 0.100% of Sn and 0.050 to 0.100% of Sb.

3. The sulfur-containing free-cutting steel for machine structural use according to claim 1, wherein said free-cutting steel contains, in weight percent, at least one selected from the group consisting of 0.10 to 2.00% of Cr, 0.10 to 2.00% of Ni and 0.05 to 1.00% of Mo.

4. The sulfur-containing free-cutting steel for machine structural use according to claim 2, wherein said free-cutting steel contains, in weight percent, at least one selected from the group consisting of 0.10 to 2.00% of Cr, 0.10 to 2.00% of Ni and 0.05 to 1.00% of Mo.

5. The sulfur-containing free-cutting steel for machine structural use according to claim 1, wherein said free-cutting steel contains, in weight percent, 0.0002 to 0.020% of Mg.

6. The sulfur-containing free-cutting steel for machine structural use according to claim 2, wherein said free-cutting steel contains, in weight percent, 0.0002 to 0.020% of Mg.

7. The sulfur-containing free-cutting steel for machine structural use according to claim 3, wherein said free-cutting steel contains, in weight percent, 0.0002 to 0.020% of Mg.

8. The sulfur-containing free-cutting steel for machine structural use according to claim 4, wherein said free-cutting steel contains, in weight percent, 0.0002 to 0.020% of Mg.

* * * * *